US006253037B1

(12) United States Patent
Park

(10) Patent No.: US 6,253,037 B1
(45) Date of Patent: Jun. 26, 2001

(54) APPARATUS AND METHOD FOR OPTIMIZING IMAGE TRANSFER ENVIRONMENT IN AN ELECTROPHOTOGRAPHIC SYSTEM

(75) Inventor: Ki-Ju Park, Kyonggido (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/314,896

(22) Filed: May 19, 1999

(30) Foreign Application Priority Data

May 19, 1998 (KR) ..... 98-17906

(51) Int. Cl.[7] ..... G03G 15/16; G03G 15/00
(52) U.S. Cl. ..... 399/44; 399/66
(58) Field of Search ..... 399/44, 45, 66, 399/316, 797, 388, 389, 397; 361/214

(56) References Cited

U.S. PATENT DOCUMENTS

| | | | | |
|---|---|---|---|---|
| 4,491,407 | * | 1/1985 | Mitsuyama et al. | 399/316 |
| 5,007,690 | | 4/1991 | Chern et al. . | |
| 5,300,984 | * | 4/1994 | Fuma et al. | 399/66 |
| 5,410,419 | | 4/1995 | Muramatsu et al. . | |
| 5,426,496 | | 6/1995 | Koike et al. . | |
| 5,443,873 | | 8/1995 | Itani et al. . | |
| 5,479,242 | | 12/1995 | Sato et al. . | |
| 5,488,463 | | 1/1996 | Nimura et al. . | |
| 5,512,983 | | 4/1996 | Fukushima et al. . | |
| 5,527,653 | | 6/1996 | Tanaka . | |
| 5,592,262 | | 1/1997 | Tanaka et al. . | |
| 5,595,846 | | 1/1997 | Shigematsu et al. . | |
| 5,608,506 | * | 3/1997 | Omoto | 399/315 |
| 5,625,437 | | 4/1997 | Furukawa . | |
| 5,665,510 | | 9/1997 | Hattori . | |
| 5,689,768 | | 11/1997 | Ehara et al. . | |
| 5,734,390 | | 3/1998 | Sakaizawa et al. . | |
| 5,740,504 | | 4/1998 | Akinaga et al. . | |

FOREIGN PATENT DOCUMENTS

| | | | |
|---|---|---|---|
| 58-14172 | * | 1/1983 | (JP) . |
| 4-21868 | * | 1/1992 | (JP) . |
| 10-26888 | * | 1/1998 | (JP) . |

* cited by examiner

*Primary Examiner*—Joan Pendegrass
(74) *Attorney, Agent, or Firm*—Robert E. Bushnell, Esq.

(57) ABSTRACT

An apparatus and a method for optimizing an image transfer environment in an electrophotographic developing device is provided. The apparatus includes at least one or more discharging parts disposed on a printing path, contacting with a printing paper as it is fed, for discharging electrostatic electricity formed on the printing paper; a feeder roller made of a conductive material, for electrically detecting an amount of humidity contained in the printing paper and for feeding the printing paper between the transfer roller and the photosensitive drum; and a ground controller for selectively controlling connection or disconnection of the at least one or more grounds based upon the humidity amount input from the feeder roller to the ground controller.

6 Claims, 5 Drawing Sheets

APPARATUS AND METHOD FOR OPTIMIZING IMAGE TRANSFER ENVIRONMENT IN AN ELECTROPHOTOGRAPHIC SYSTEM

CLAIM OF PRIORITY

This application makes reference to, incorporates the same herein, and claims all benefits under 35 U.S.C. 119 from an application for APPARATUS AND METHOD FOR OPTIMIZING IMAGE TRANSFER ENVIRONMENT IN AN ELECTROPHOTOGRAPHIC SYSTEM earlier filed in the Korean Industrial Property Office on the $19^{th}$ of May 1998 and there duly assigned Serial No. 17906/1998.

BACKGROUND OF THE INVENTION

1. Field of the Invention

The present invention relates generally to an electrophotographic system such as a color laser beam printer and a color copier. More particularly, the present invention relates to an apparatus and a method for optimizing an image transfer environment in an electrophotographic system from sensing of humidity contained in a printing medium.

2. Description of the Related Art

Generally, in an electrophotographic system used in a copier, laser printer, facsimile machine, etc., a charging roller is rotated and evenly charges a photosensitive body on the outer peripheral surface of a photosensitive drum with a high pressure.

Moreover, the photosensitive body which is charged on the outer peripheral surface of the photosensitive drum forms an electrostatic latent image by a light emitted from an optical source of an exposing device such as a laser diode which changes an image digital signal to a laser beam.

At this time, the electrostatic latent image formed on the photosensitive drum is developed by a developing substance, such as toner powder when passing through a developer, and then it is changed into a visible toner image. The visible toner image is transferred onto a printable medium, that is printing paper, and then it is fixed on the printing paper by fusing the transferred visible toner image.

Meanwhile, such an electrophotographic system can print a color image if it is provided with plural color toners. Like the widely known multicolors image forming apparatus capable of displaying yellow, magenta, cyan, and black colors, a multicolor electrophotographic system accomplishes display of multicolors by means of four color toners, that is, yellow, magenta, cyan, and black.

Recently, an electrophotographic system has been most desirable in printing an image with high resolution, but its price is very high. However, since the system has advantages of high printing speed, fine image quality, superior durability etc., its use has been escalated in all applications.

In relation to the above electrophotographic system, many exemplars of contemporary practice are disclosed. Among the exemplars of the contemporary practice on this matter, Ehara et al.(U.S. Pat. No. 5,689,768, ELECTROPHOTOGRAPHING APPARATUS FOR COLLECTING TONER FROM A PHOTOSENSITIVE MEMBER AND CONVEYING IT TO DEVELOPING MEANS, Nov. 18, 1997) discusses an electrophotographing apparatus with a reusable toner system. Akinaga et al.(U.S. Pat. No. 5,740,504, ELECTROPHOGOGRAPHING METHOD USING CARONA CHARGINGDEVICEHAVINGAREAS WITH AND WITHOUT A GRID, Apr. 14,1998) discusses a charging effected using both areas relative to the grid. Tanaka et al.(U.S. Pat. No. 5,592,262, IMAGE FORMING APPARATUS WITH INK JET AND ELECTROPHOTOGRAPHIC RECORDING UNITS, Jan. 7, 1997) discusses a plurality of different image forming units for recording with different methods. Sakaizawa et al.(U.S. Pat. No. 5,734,390, IMAGE FORMING APPARATUS, Mar. 31, 1998) discusses a hybrid type image forming apparatus capable of forming a high quality image by using two image forming units having different resolution from each other. Sato et al.(U.S. Pat. No. 5,479,242, FAN SYSTEM FOR ELECTROPHOTOGRAPHIC APPARATUS, Dec. 26, 1995) discusses a fan system for an electrophotographic apparatus which is provided to simultaneously induce air flow over or through at least two components of the electrophotographic apparatus. Hattori(U.S. Pat. No. 5,665,510, TONER FOR ELECTROPHOTOGRAPHAND PROCESS FOR THE PRODUCTION THEREOF, Sep. 9,1997) discusses a toner for electrophotography which contains a binder resin having a low softening point so that the toner can be fixed at a low temperature, and which is free from blocking. Furukawa (U.S. Pat. No. 5,625,437, IMAGE FORMING APPARATUS, Apr. 29, 1997) discusses an image forming apparatus in which downsizing of the entire apparatus can be attained. Shigematsu et al.(U.S. Pat. No. 5,595,846, PHTHALOCYANINE MIXED CRYSTAL, PRODUCTION METHOD THEREOF, AND ELECTROPHOTOGRAPHIC PHOTORECEPTOR, Jan. 21, 1997) discusses an electrophotographic photoreceptor composed of an electrically conductive substrate having formed thereon a photosensitive layer containing a phthalocyanine mixed crystal comprising titanyl phthalocyanine and hydrogen phthalocyanine. Chern et al. (U.S. Pat. No. 5,007,690, HOLOGRAPHIC DATA STORAGE AND RETRIEVAL SYSTEM, Apr. 16, 1991) discusses a plurality of reflective diffusing holographic memory elements. Tanaka(U.S. Pat. No. 5,527,653, ELECTROPHOTOGRAPHIC PHOTOSENSITIVE MEMBER, PROCESS CARTRIDGE AND ELECTROPHOTOGRAPHIC APPARATUS WHICH EMPLOY THE SAME, Jun. 18, 1996) discusses an electrophotographic photosensitive member including a conductive substrate and a photosensitive layer thereon. Fukushima et al.(U.S. Pat. No. 5,512,983, ELECTROPHOTOGRAPHING APPARATUS WITH FIRSTAND SECOND CHARGE DEVICES, Apr. 30, 1996) discusses an electrophotography apparatus with a photosensitive body, first charge devices for performing a first charge process to form an image on the photosensitive body, and two transfer chargers having the same polarity. Nimura et al.(U.S. Pat. No. 5,488,463, IMAGE FORMING APPARATUS TO FORM IMAGES ONTO A SHEET A PLURALITY OF TIMES, Jan. 30, 1996) discusses an image forming unit having first and second conveying units for conveying the sheet from the image forming unit to the image forming unit. Itani et al.(U.S. Pat. No. 5,443,873, SILICON RUBBER FOR ELECTROPHOTOGRAPHYAND METHOD OF PRODUCING THE SAME, Aug. 22, 1995) discusses an electrically conductive rubber roller for electrophotography which changes very little in electric resistance with changes in environment. Koike et al.(U.S. Pat. No. 5,426,496, PRINTING APPARATUS, Jun. 20, 1995) discusses a slim printing apparatus which employs a latent image forming method, such as electrophotographing method, and needs an apparatus-occupying area. Muramatsu et al.(U.S. Pat. No. 5,410,419, FACSIMILE MACHINE CAPABLE OF DISTINGUISHING COPIED IMAGE AND RECEIVED IMAGE, Apr. 25, 1995) discusses a facsimile machine which can set a so-called night time collective time designation mode for power saving during night time processing time. From my study of the contemporary practice and of the art, I find that there is a need for an effective and improved apparatus for optimizing an image transfer environment by detection of humidity contained in a printing medium such as paper which results in enhancement in printing quality without spots due to spreading of a developing substance such as toner.

SUMMARY OF THE INVENTION

Therefore, an object of the present invention is to provide an apparatus and a method which can optimize an image transfer environment by detecting humidity contained in a printing medium and controlling leakage of an image transfer current according to the humidity detected.

This object and others of the present invention can be achieved by an apparatus for optimizing an image transfer environment in an electrophotographic system including:

- a photosensitive drum for forming a visible image on the peripheral surface of the drum;
- a transfer roller for transferring the visible image to a printing paper;
- a fusing roller for fixing the visible image of the transfer roller onto the printing paper;
- at least one discharging part disposed on a printing path, contacting with the printing paper as it is fed, for discharging electrostatic electricity formed on the printing paper;
- a feeder roller made of a conductive material, for electrically detecting an amount of humidity contained in the printing paper and feeding the printing paper between the transfer roller and the photosensitive drum;
- an idler roller positioned in facing relation to the feeder roller; and
- ground control means for selectively controlling a connect and disconnect of at least one ground based upon the amount of humidity input from the feeder roller.

According to another aspect of the present invention, there is provided a method for optimizing an image transfer environment in an electrophotographic system. The method includes the steps of:

- sensing a relative position of the printing paper which is fed along the printing path;
- applying a measuring voltage to the feeder roller for measuring an amount of humidity contained in the printing paper when the printing paper is fed between the feeder roller and the idler roller;
- measuring a leakage current flowing through the printing paper when the measuring voltage is applied to the feeder roller; and
- controlling operation of the discharging part for discharging electrostatic electricity formed on the printing paper from a comparison of the measured leakage current with a predesignated reference current.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
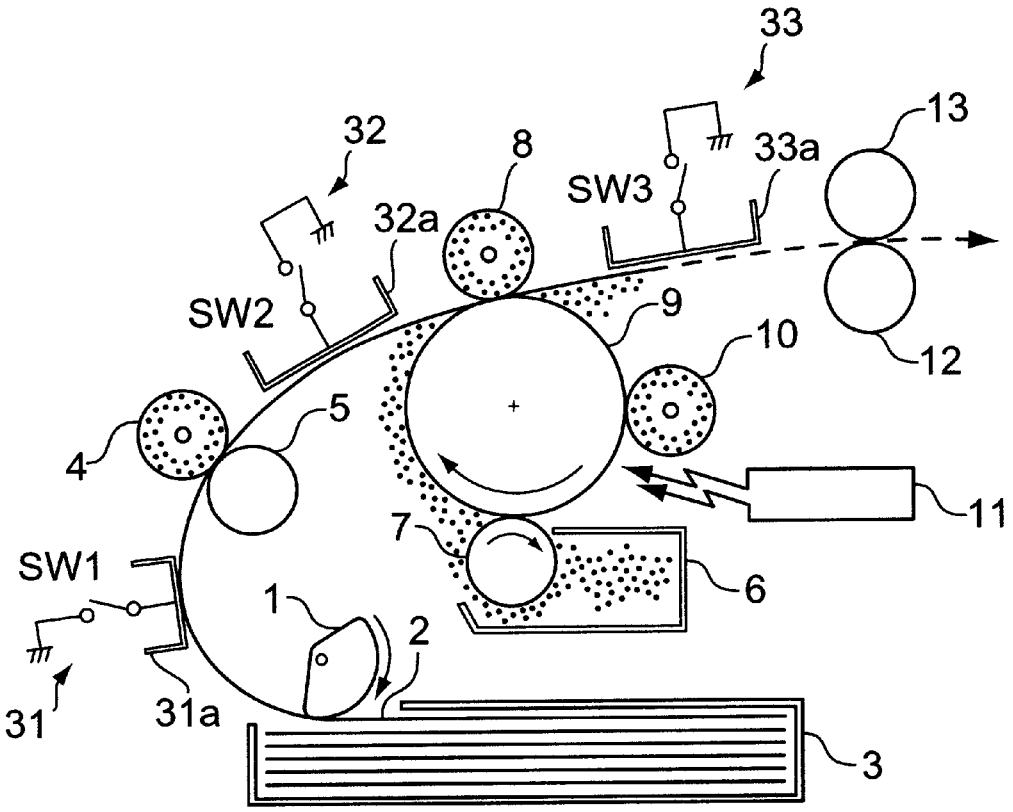
FIG. 1 is a schematic view of an inside of a electrophotographic system exemplary of contemporary practice in the art to which the present invention is applicable.

Turning now to the drawings, FIG. 1 shows a diagrammatic internal scheme of a contemporary electrophotographic system to which the present invention is applicable. As shown in this FIG. 1, the electrophotographic system includes an organic photoconductive drum (herein below referred to as OPC drum) 9 for forming a visible image onto a printing paper 2, a laser scanning unit 11 for scanning a laser beam to the OPC drum 9, a pickup roller 1 for picking up the printing paper 2 in a paper cassette 3 one by one, a feeder roller 4 for feeding the printing paper 2 to the OPC drum 9, an idler roller 5 positioned in facing relation to the feeder roller, a developing roller 7 for developing a visible toner image formed on the peripheral surface of the OPC drum 9, a transfer roller 8 for transferring an electrostatic latent image on the OPC drum 9, a charging roller 10 for charging the peripheral surface of the OPC drum 9 prior to forming an electrostatic latent image, a heating roller 12 for heating the visible toner image to a predesignated temperature when the print command is inputted, and a compress roller 13 for fusing the transferred visible toner image onto the printing paper 2. In FIG. 1, numeral 6 is a developing unit.

Figure 2:
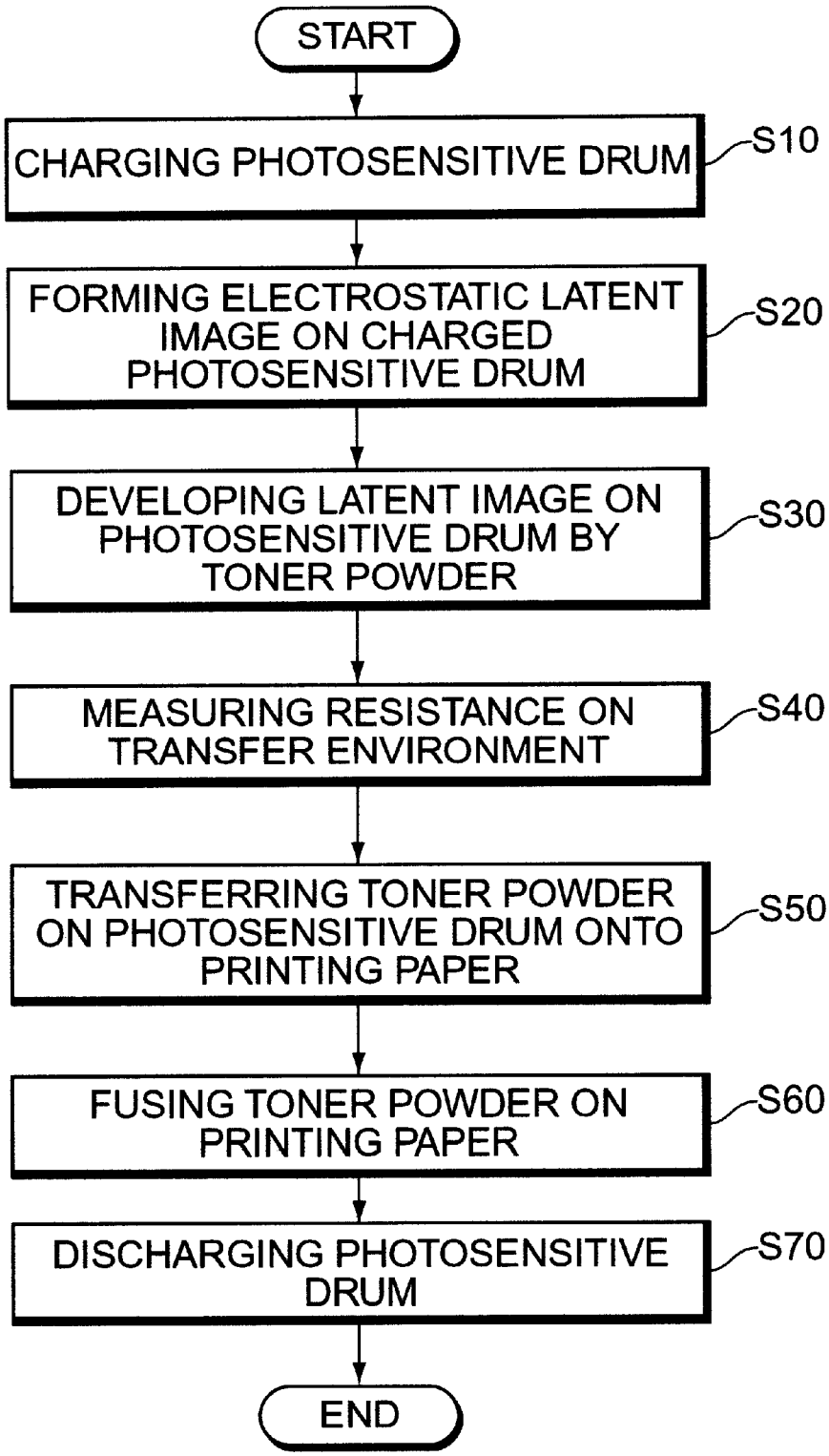
FIG. 2 is a flow chart showing an image forming method of the system of FIG. 1.

As shown in FIG. 2, a desirable image is formed on the printing paper 2 by performing an image forming process including the steps of: charging the photosensitive drum (step S10), exposing the surface of the photosensitive drum by forming an electrostatic latent image on the charged photosensitive drum (step S20); developing the latent image on the photosensitive drum by toner powder (step S30); measuring resistance on the transfer environment (step S40); image transferring by transferring toner powder on the surface of the photosensitive drum onto printing paper (step S50); image fusing by fusing toner powder onto the printing paper (step S60); and discharging the photosensitive drum by interaction of the above-mentioned rollers (step S70).

Referring now to FIG. 1 through 4, firstly, as the print command is applied to the electrophotographic system, the pickup roller 1 contacts with the uppermost sheet of a printing paper 2 of a paper cassette 3, and then picks up the uppermost sheet. Thereafter, the uppermost sheet of paper 2 is fed to the feeder roller 4. Simultaneously, a charging layer (or latent image), which corresponds to an image for printing, is formed on the OPC drum 9 by interaction of the charging roller 10 and the exposing unit 11. Thereafter, a developing substance, such as toner powder, is coated on portions where the charging layer is formed, to thereby form a visible toner image.

When the printing paper 2, as picked up, is fed between the image transfer roller 8 and the OPC drum 9 via the feeder roller 4, a high transfer voltage is applied to the transfer roller 8 to transfer the visible toner image formed on the OPC drum 9 onto the printing paper 2. The visible toner image transferred onto the printing paper 2 is fixed by fusing the same using pressure and heat of the heating roller 12 and the compress roller 13.

At this time, in order to prevent current from being unnecessarily leaked through the printing paper 2, the printing paper 2 should have a proper resistance. Therefore, a sufficient electric attractive force is applied to the visible toner image which is formed on the peripheral surface of the OPC drum 9, whereby the visible toner image is effectively transferred onto the printing paper 2.

Figure 3:
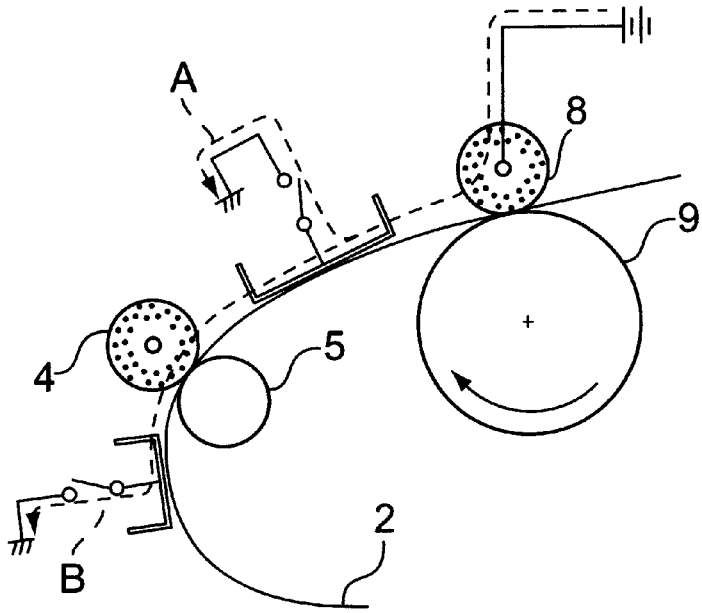
FIG. 3 is a schematic view showing leakage of current in the system of FIG. 1.

For example, when the printing paper 2 contains a considerable amount of humidity, the resistance of the paper 2 is relatively low. Therefore, the transfer current, which provides an electric attractive force to the visible toner image, flows into the ground terminals of discharging parts 31, 32, 33, that is, as shown in FIG. 3, along electric paths A and B, that each of the discharging parts 31 through 33 provides. However when the transfer current is leaked, such leakage thereby can cause the visible toner image to improperly be transferred onto the printing paper 2.

In order to avoid this problem, when the printing paper 2 is not grounded, electrostatic electricity is generated in the printing paper 2 due to the friction between a plurality of the printing papers or between the printing paper and the rollers while the printing paper 2 is moved along the printing path.

Figure 4:
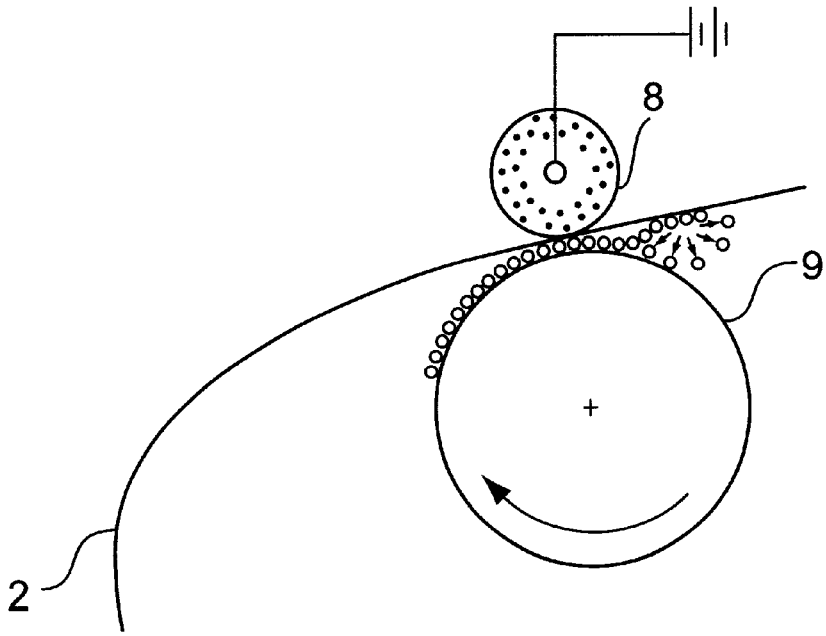
FIG. 4 is a schematic view showing generation of a spot or spots in the system of FIG. 1.

If the electric path for discharging this electrostatic electricity is not provided, the visible toner image can spread over the printing paper 2 by residual electrostatic electricity, to thereby generate spots on the printing paper 2 as shown in FIG. 4 and hence poor quality of the visible image is inevitable.

Thus, the present invention provides a proposed technique and apparatus to employ a humidity adaptive control part capable of controlling operation of the discharging parts 31, 32, 33.

The present invention now will be described more fully hereinafter with reference to the accompanying drawings, particularly FIGS. 5 and 6, in which preferred embodiments of the invention are shown.

Figure 5:
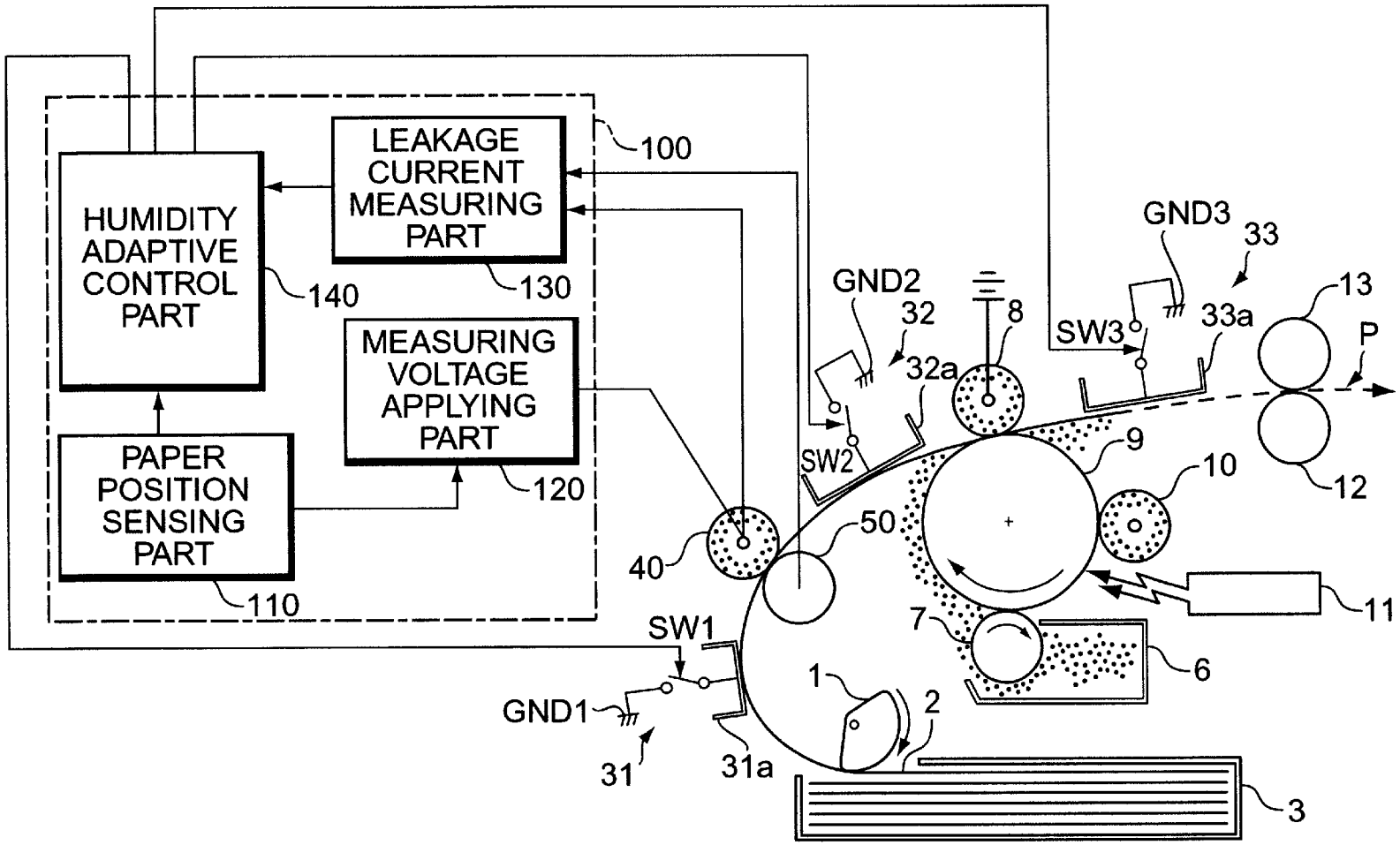
FIG. 5 is a block diagram of an image transfer environment optimizing apparatus according to an embodiment of the present invention.

FIG. 5 shows an image transfer environment optimizing apparatus according to an embodiment of the present invention.

Referring to FIG. 5, the optimizing apparatus includes at least one or more, preferably three, discharging parts 31 through 33 disposed at least one or more, preferably three, places on printing path P, for discharging electrostatic electricity formed on printing paper 2; a feeder roller 40 made of a conductive material so as to electrically sense humidity contained in the printing paper 2, and for supplying the printing paper 2 toward the junction face between the image transfer roller 8; and the OPC drum 9, an idler roller 50 made of insulating material so as to maintain insulation from the feeder roller 40 and positioned in facing relation to the feeder roller 40, and a ground control unit 100 for selectively controlling a connect and a disconnect of the three discharging parts 31, 32, 33 from leakage current corresponding to the humidity amount inputted from the feeder roller 40 to the ground control unit 100.

Continuing with reference to FIG. 5, the ground controller or ground control unit 100 includes a paper position sensing part 110 for sensing a relative position of the printing paper 2 which is fed along the printing path P, a measuring voltage applying part 120 for applying a humidity measuring voltage for the measurement of the amount of humidity contained in the printing paper 2 to the feeder roller 40 when the printing paper 2 is fed to the junction face between the feeder roller 40 and the idler roller 50, a leakage current measuring part 130 for measuring a leakage current flowing through the printing paper 2 when the measuring voltage is applied to the feeder roller 40, and a humidity adaptive control part 140 for comparing the leakage current inputted from the leakage current measuring part 130 with a predesignated reference current, and for respectively selectively controlling the discharging parts 31, 32, 33 to be grounded when the value of the leakage current is smaller than or the same as the value of the predesignated reference current and not to be grounded when the value of the leakage current is greater than the value of the predesignated reference current.

If the print command is input to the electrophotographic system of FIG. 5, the pickup roller 1 contacts with the uppermost sheet of the printing paper 2 in the paper cassette 3, picks up one sheet, and supplies the same to the feeder roller 40.

Afterwards, as the printing paper 2 which is being moved toward the feeder roller 40 is fed at the junction face between the feeder roller 40 and the idler roller 50, the ground control unit 100 applies the humidity measuring voltage to the feeder roller 40 in order to measure the humidity contained in the printing paper 2. As the humidity measuring voltage is applied to the feeder roller 40, the leakage current measuring part 130 measures leakage current flowing through the printing paper 2. Thereafter, the measured leakage current is inputted into the humidity adaptive control part 140. Afterwards, from the leakage current value input from the leakage current measuring part 130, the ground control part 100 selectively controls connection and disconnection of the discharging parts 31, 32, 33, to thereby optimize the transfer environment.

In more detail, continuing with reference to FIG. 5, the paper position sensing part 110 senses the relative position of the printing paper 2 which is being fed along the printing path P. At this time, as one example for indirectly sensing the relative position of the printing paper 2 on the printing path P, there is a method of counting the time taken from when the feeder roller 40 starts to pick up the printing paper 2. As examples for directly sensing the position of the printing paper 2 on printing path P, there is a method utilizing a physical paper position sensor and another method perceiving a variation in pressure sensed in the feeder roller 40 or the idler roller 50 during the feeding of the printing paper 2. In addition to the above metioned methods, other methods are known to those skilled to the art for sensing the position of the printing paper 2 on the printing path P.

Meanwhile, continuing with reference to FIG. 5, as soon as the measuring voltage applying part 120 receives a signal that the printing paper 2 is being fed at the junction face between the feeder roller 40 and the idler roller 50, measuring voltage applying part 120 applies the humidity measuring voltage for measuring the amount of humidity contained in the printing paper 2 to the feeder roller 40. As the humidity measuring voltage is applied to the feeder roller 40, the leakage current measuring part 130 measures the leakage current flowing through the printing paper 2.

If the measuring voltage of the humidity amount is fixed to a value, the leakage current measured by the leakage current measuring part 130 is proportional to the humidity contained in the printing paper 2. In other words, when the humidity is extremely low, the printing paper 2 has a very high resistance value, and the leakage current is measured as a very smaller value. Whereas when the humidity is high, the printing paper 2 has a comparatively low resistance value, and the leakage current is measured as a relatively larger value. As described previously, the present invention employs an apparatus and method of determining or measuring the humidity of the printing paper through the measurement of the leakage current flowing through the printing paper, based on a fact that the resistance value of the printing paper is varied with the humidity contained in the printing paper.

As a result, the humidity adaptive control part 140 optimizes the image transfer environment by comparing a value of a predesignated reference current with the value of the leakage current input from the leakage current measuring part 130 and controlling the discharging parts 31, 32, 33 to be grounded when the leakage current is smaller than or the same as the predesignated reference current and not to be grounded when the leakage current is greater than the predesignated reference current. Therefor, the leakage of the transfer voltage through the printing paper 2 can be prevented.

In the electrophotographic apparatus of FIG. 5, the discharging parts includes a first discharging part 31, a second discharging part 32, and a third discharging part 33. The first discharging part 31 includes a first conductive contact part 31*a* which contacts with the printing paper 2, a first ground terminal GND1, and a first switch SW1 connected between the first conductive contact part 31*a* and the first ground terminal GND1. The second discharging part 32 includes a second conductive contact part 32*a* which contacts with the printing paper 2, a second ground terminal GND2, and a second switch SW2 connected between the second conductive contact part 32*a* and the second ground terminal GND2. The third discharging part 33 includes a third conductive contact part 33*a* which contacts with the printing paper 2 as it is fed, a third ground terminal GND3, and a switch SW3, connected between the third conductive contact part 33*a* and the third ground terminal GND3.

As shown in FIG. 5, the first discharging part 31 is disposed between the pickup roller 1 and the feeder roller 40, the second discharging part 32 is disposed between the feeder roller 40 and the transfer roller 8, and the third discharging part 33 is disposed between the transfer roller 8 and the compress roller 13. Here, as the switches SW1, SW2, SW3 are selectively turned on and off, the first to third discharging parts 31, 32, 33 make the leakage current flowing through the printing paper 2 to be grounded or not to be grounded. Therefore, it is required that turning on or off of the first to third swithces SW1, SW2, SW3 of the respective first through third discharging parts 31 through 33, be sequentially controlled according to the relative position of the printing paper 2 on the printing path P.

Figure 6:
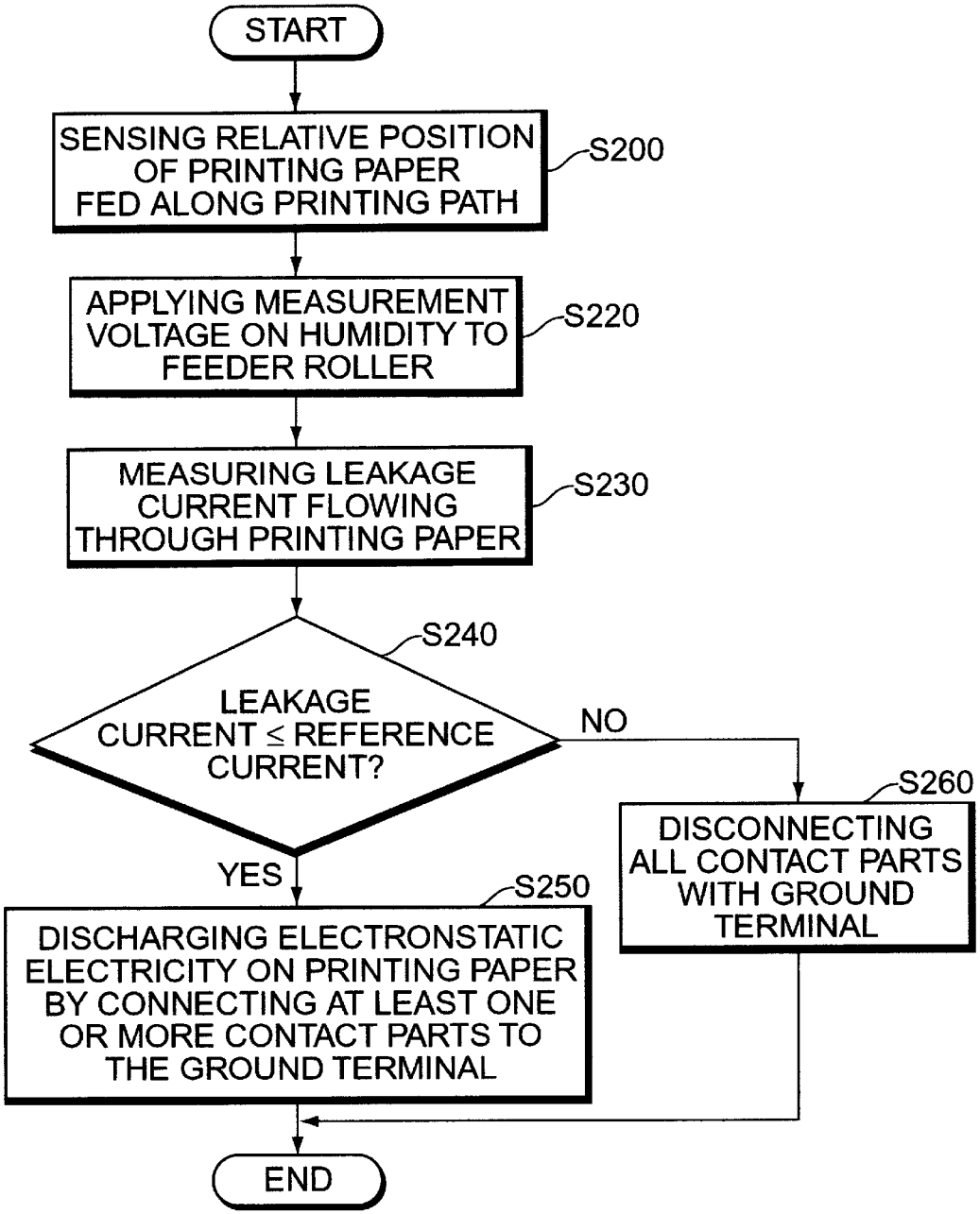
FIG. 6 is a flow chart illustrating a method for optimizing an image transfer environment in the system of FIG. 5.

FIG. 6 is a flow chart illustrating a method for optimizing an image transfer environment according to the present invention.

The description of the method illustrated in FIG. 6 will be made with reference to an embodiment of the electrophotographic system for applying the optimizing method of FIG. 5 which includes: at least one or more, preferably three discharging parts 31, 32, 33 disposed onprinting path P, contacting with a printing paper 2 as it is fed, and for discharging electrostatic electricity formed on the printing paper 2; a feeder roller 40 made of a conductive material so as to sense the amount of the humidity of the printing paper 2, and for supplying the printing paper toward the junction face between the transfer roller 8 and the OPC drum 9; and an idler roller 50 positioned in facing relation to the feeder roller 40 and made of an insulating material so as to maintain insulation from the feeder roller 40 during contact with the feeder roller 40.

Referring to FIG. 6, if the print command is input to the electrographic system, the pickup roller 1 contacts with the uppermost sheet of the printing paper 2 in the paper cassette 3, and picks up the uppermost sheet of the printing paper 2, and supplies the same to the feeder roller 40. At this time, the relative position of the printing paper 2 moving along the printing path P is sensed (step S200).

Afterwards, as soon as the measuring voltage applying part 120 receives a signal that the printing paper 2 is being fed at the junction face between the feeder roller 40 and the idle roller 50, it applies a humidity measuring voltage for measuring the amount of humidity contained in the printing paper 2 to the feeder roller 40 (step S220). As the measuring voltage is applied to the feeder roller 40, the leakage current measuring part 130 measures the value of the leakage current flowing through the printing paper 2 (step S230). Thereafter, the measured leakage current is input into the humidity adaptive control part 140. Afterwards, the humidity adaptive control part 140 compares a value of predesignated reference current with the value of the leakage current and then determines that the leakage current is smaller than or the same as the predesignated reference current (step S240).

From the result determined in the step S240, when the leakage current is smaller than or the same as the predesignated reference current, the humidity adaptive control part 140 controls to selectively turn on typically one or more of the switches SW1, SW2, SW3 of the discharging parts 31, 32, 33 dependent upon the value of the measured leakage current (step S250). As a result, the electrostatic electricity generated in the printing paper 2 selectively flows in respective ground terminals GND1, GND2, GND3 of the discharging parts 31, 32, 33, and is discharged.

On the other hand, when the measured leakage current is greater than the predesignated reference current, the humidity adaptive control part 140 controls to selectively turn off the switches SW1, SW2, SW3 of the discharging parts 31, 32, 33 (step S260). As a result, the electrostatic electricity generated in the printing paper 2 does not flow into the respective ground terminals GND1, GND2, GND3 of the discharging parts 31, 32, 33, and thereby the leakage of the transfer voltage through the printing paper 2 is prevented.

As described previously, when the humidity of the printing paper is relatively high, it is anticipated that the transfer current is leaked, and the switches SW1, SW2, SW3 of the discharging parts 31, 32, 33 become open, whereas, in a normal state in which the humidity of the printing paper 2 is very low, the switches SW1, SW2, SW3 selectively are closed. Accordingly, the image transfer environment optimizing apparatus in an electrophotographic system and method according to the present invention is advantageous for effectively discharging residual electrostatic electricity formed on the printing paper.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An apparatus for optimizing an image transfer environment in an electrophotographic system, comprising:

a photosensitive drum for forming a visible image on a peripheral surface of the photosensitive drum;

a transfer roller for transferring the visible image formed on the peripheral surface of the photosensitive drum onto a printing paper;

a compress roller for fixing the visible image transferred onto the printing paper;

at least one discharging part disposed on a printing path for the printing paper, for contacting with the printing paper on the printing path, and for discharging electrostatic electricity formed on the printing paper;

a feeder roller made of a conductive material, for electrically detecting a leakage current corresponding to an amount of humidity contained in the printing paper and for feeding the printing paper between the transfer roller and the photosensitive drum;

an idler roller positioned in facing relation to the feeder roller; and a ground controller for selectively controlling connecting and disconnecting of the at least one discharging part to a ground for discharging the electrostatic electricity formed on the printing paper according to the leakage current detected corresponding to the amount of humidity contained in the printing paper input from the feeder roller to the ground controller, the at least one discharging part comprising:

a first discharging part comprising a first conductive contact part for contact with the printing paper on the printing path, a first ground terminal, and a first switch connected between the first conductive contact part and the first ground terminal, the first discharging part being disposed at a position on the printing path between a pickup roller for picking up the printing paper and the feeder roller;

a second discharging part comprising a second conductive contact part for contact with the printing paper on the printing path, a second ground terminal, and a second switch connected between the second conductive contact part and the second ground terminal, the second discharging part being disposed at a position on the printing path between the feeder roller and the transfer roller; and a third discharging part comprising a third conductive contact part for contact with the printing paper on the printing path, a third ground terminal, and a third switch connected between the third conductive contact part and the third ground terminal, the third discharging part being disposed at a position on the printing path between the transfer roller and the compress roller, the compress roller being located on the printing path for fusing the visible image transferred onto the printing paper.

2. The apparatus of claim 1, further comprised of the ground controller comprising:

a paper position sensing part for sensing a relative position of the printing paper on the printing path as the printing paper is being fed along the printing path;

a measuring voltage applying part for applying a measuring voltage to the feeder roller for a measurement of the leakage current corresponding to the amount of humidity contained in the printing paper;

a leakage current measuring part for measuring the leakage current flowing through the printing paper when the measuring voltage is applied to the feeder roller; and a humidity adaptive control part for comparing a value of a predesignated reference current with a value of the leakage current measured input from the leakage current measuring part, and for selectively controlling the at least one discharging part to be grounded when the value of the leakage current measured is one of smaller than and the same as the value of the predesignated reference current and not to be grounded when the value of the leakage current measured is greater than the value of the predesignated reference current.

3. The apparatus of claim 2, further comprised of the idler roller comprising an insulator material so as to maintain insulation from the feeder roller while the idler roller is in contact with the feeder roller.

4. The apparatus of claim 1, further comprised of the idler roller comprising an insulator material so as to maintain insulation from the feeder roller while the idler roller is in contact with the feeder roller.

5. A method for optimizing an image transfer environment in an electrophotographic system, comprising the steps of:

providing an electrophotographic system, said electrophotographic system including: at least one discharging part disposed on a printing path for a printing paper, for contacting with a printing paper on the printing path, and for discharging electrostatic electricity formed on the printing paper; a photosensitive drum for forming a visible image on a peripheral surface of the photosensitive drum; a transfer roller for transferring said visible image formed on the peripheral surface of the photosensitive drum onto the printing paper; a feeder roller made of a conductive material, for electrically detecting a leakage current corresponding to an amount of humidity contained in the printing paper and for feeding the printing paper between the transfer roller and the photosensitive drum; and an idler roller positioned in facing relation to the feeder roller;

sensing a relative position of the printing paper on the printing path;

applying a measuring voltage to the feeder roller for measuring the leakage current corresponding to the amount of humidity contained in the printing paper when the printing paper is fed between the feeder roller and the idler roller;

measuring the leakage current flowing through the printing paper when the measuring voltage is applied to the feeder roller; and controlling selectively operation of the at least one discharging part based upon a comparison of the leakage current measured with a predesignated reference current, the at least one discharging part comprising:

a first discharging part comprising a first conductive contact part for contact with the printing paper on the printing path, a first ground terminal, and a first switch connected between the first conductive contact part and the first ground terminal, the first discharging part being disposed at a position on the printing path between a pickup roller for picking up the printing paper and the feeder roller;

a second discharging part comprising a second conductive contact part for contact with the printing paper on the printing path, a second ground terminal, and a second switch connected between the second conductive contact part and the second ground terminal, the second discharging part being disposed at a position on the printing path between the feeder roller and the transfer roller; and a third discharging part comprising a third conductive contact part for contact with the printing paper on the printing path, a third ground terminal, and a third switch connected between the third conductive contact part and the third ground terminal, the third discharging part being disposed at a position on the printing path between the transfer roller and a compress roller, the compress roller being located on the printing path for fusing the visible image transferred onto the printing paper.

6. The method of claim 5, further comprised of said controlling step controls the at least one discharging part to be grounded when a value of the leakage current measured is one of smaller than and same as a value of the predesignated reference current and not to be grounded when the value of the leakage current measured is greater than the value of the predesignated reference current.

* * * * *